US008891810B2

(12) United States Patent
Reckert

(10) Patent No.: US 8,891,810 B2
(45) Date of Patent: Nov. 18, 2014

(54) FLAT DIAPHRAGM LOUDSPEAKER

(75) Inventor: Sascha Reckert, Berlin (DE)

(73) Assignee: Lautsprecher Teufel GmbH, Berlin (DE)

( * ) Notice: Subject to any disclaimer, the term of this patent is extended or adjusted under 35 U.S.C. 154(b) by 135 days.

(21) Appl. No.: 13/125,140

(22) PCT Filed: Oct. 21, 2009

(86) PCT No.: PCT/EP2009/007635

§ 371 (c)(1),
(2), (4) Date: Aug. 8, 2011

(87) PCT Pub. No.: WO2010/046132

PCT Pub. Date: Apr. 29, 2010

(65) Prior Publication Data

US 2011/0299716 A1 Dec. 8, 2011

(30) Foreign Application Priority Data

Oct. 21, 2008 (EP) ..... 08075841

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 25/00*** | (2006.01) |
| ***H04R 9/02*** | (2006.01) |
| ***H04R 7/20*** | (2006.01) |
| ***H04R 7/02*** | (2006.01) |
| *H04R 7/10* | (2006.01) |
| *H04R 1/24* | (2006.01) |

(52) U.S. Cl.

CPC .. *H04R 7/20* (2013.01); *H04R 7/10* (2013.01); *H04R 1/24* (2013.01); *H04R 9/025* (2013.01); *H04R 2307/204* (2013.01); *H04R 2231/003* (2013.01); *H04R 7/02* (2013.01); *H04R 2307/207* (2013.01)

USPC ..... 381/423; 381/184; 381/426; 381/431

(58) Field of Classification Search

USPC ..... 381/184, 398.403, 423–426, 428, 431; 181/169–170

See application file for complete search history.

(56) References Cited

U.S. PATENT DOCUMENTS 1,832,832 A * 11/1931 Nagelvoort ..... 181/174
3,046,362 A * 7/1962 White ..... 381/419

(Continued)

FOREIGN PATENT DOCUMENTS

GB 2 335 821 A 9/1999
JP 56 013896 A 2/1981

(Continued)

OTHER PUBLICATIONS

"Voice Coil." Wikipedia: The Free Encyclopedia. Wikimedia Foundation, Inc. Apr. 23, 2013. Web. Sep. 12, 2013. <http://en.wikipedia.org/wiki/Voice_coil>.

*Primary Examiner* — Matthew Eason

(74) *Attorney, Agent, or Firm* — Joyce von Natzmer; Agris & von Natzmer LLP

(57) ABSTRACT

The invention relates to a loudspeaker system in which the diaphragm of the speaker has a defined material thickness particularly in the edge region thereof and comprises a suspension which is axially symmetrical about the mechanical rest position of said diaphragm and is formed by one, preferably two identical mirrored components, characterized in that the sound emission towards the rear is performed to at least 50 percent by the inner space of a magnetic system. The invention further relates to the use of the loudspeaker system as loudspeaker boxes or in radios, television screens, radio receivers, hand-held radio devices, measurement receivers, mobile telephones and headphones or the like.

14 Claims, 3 Drawing Sheets

(56) References Cited

U.S. PATENT DOCUMENTS

Figure 1:
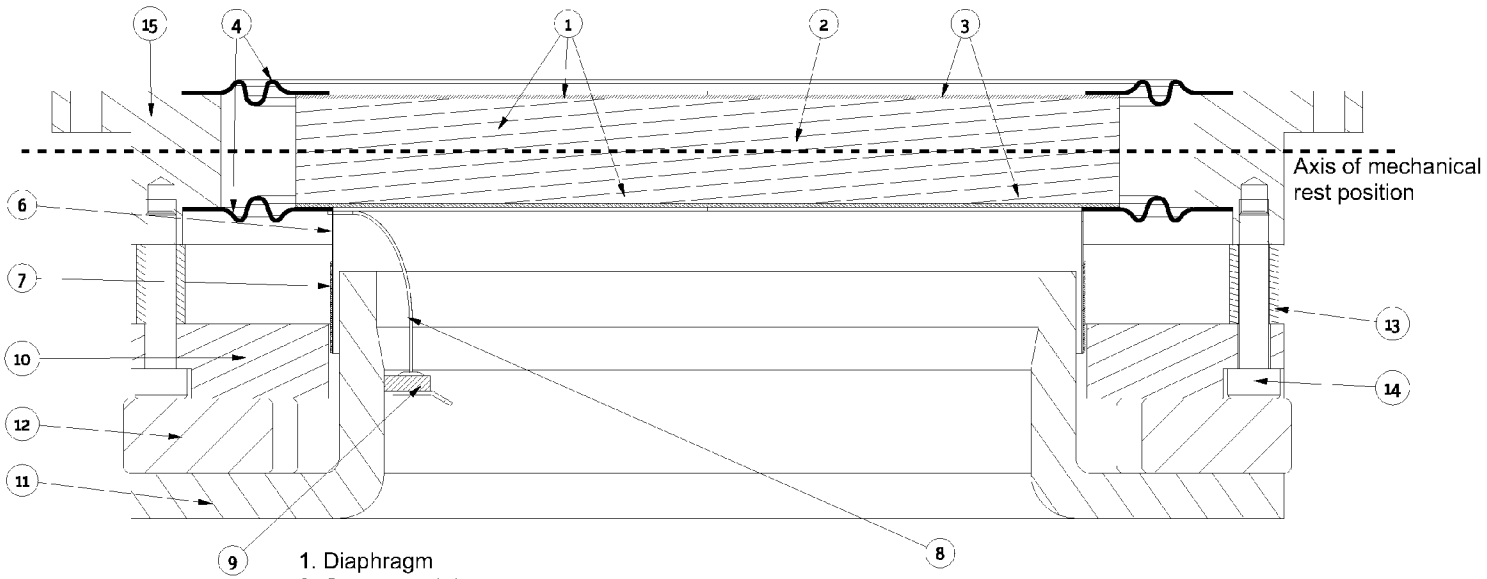

| | | | | |
|---|---|---|---|---|
| 3,111,187 | A * | 11/1963 | Barlow | 181/168 |
| 4,410,768 | A * | 10/1983 | Nakamura et al. | 381/423 |
| 6,044,925 | A | 4/2000 | Sahyoun | |
| 6,259,800 | B1 * | 7/2001 | Tagami | 381/412 |
| 6,269,168 | B1 * | 7/2001 | Tagami | 381/412 |
| 7,286,681 | B2 | 10/2007 | Gerkinsmeyer | |

FOREIGN PATENT DOCUMENTS

| | | | |
|---|---|---|---|
| JP | 60 091798 | A | 5/1985 |
| WO | 98/47317 | A1 | 10/1998 |
| WO | 2004/068898 | A1 | 8/2004 |

* cited by examiner

1. Diaphragm
2. Core material
3. Surface layer
4. Spider
5. Suspension (one-piece)
6. Voice coil former
7. Voice coil
8. Lead wire
9. Terminal
10. Upper pole plate
11. Bottom pole plate
12. Magnet
13. Distance cube
14. Screw
15. Basket 1. Diaphragm
4. Suspension (two-piece)
5. Suspension (one-piece)
15. Basket
16. Tweeter
17. Inner suspension/sealing ring

FLAT DIAPHRAGM LOUDSPEAKER

This is the U.S. national stage of International application PCT/EP2009/007635, filed Oct. 21, 2009 designating the United States and claiming priority to EP 08075841.0, filed Oct. 21, 2008.

The invention relates to a loudspeaker system in which the diaphragm of the loudspeaker, in particular in its peripheral region, has a defined thickness and in which the mechanical resting position of this diaphragm has an axially symmetrical suspension in the form of one, or preferably two, mirrored, identical components and the rear sound radiation is realized to at least 50% through the interior of a magnet system; the invention also relates to the use of the loudspeaker system as a loudspeaker for radios, televisions, radio receivers, hand-held radios, test receivers, cell phones and headphones or the like.

In the strict sense of the term, a loudspeaker is a device which transforms low-frequency electrical signals into sound. More generally, loudspeakers are sometimes subsumed under the term sound transducer or speaker. Sound commonly refers to noises, tones, notes or other sound types, as they are auditorily perceived by people or animals. Since loudspeakers are used in all areas of life such as at movie theaters, on television sets, but specifically also in headphones or portable radio devices, speakers come in different sizes and designs and especially in very different qualities. For the size of the loudspeakers, especially for the size of the loudspeaker diaphragms, the rule is: the higher the tone to be generated, the smaller the dimensions, which is associated with many other issues.

Loudspeakers are also referred to as a chassis or driver in the state of the art, although these terms only describe certain elements of a loudspeaker system, such as the so-called basket or the diaphragm actuator.

The basic principle of many state-of-the-art loudspeakers is based on a conversion of electrical energy into sound waves by the interaction of at least one diaphragm, a suspension of it, a magnet system and a voice coil as, for example, described in WO 98 47 317. This usually involves the use of flat funnel-shaped, tapered concentric diaphragms, as described, for example, in GB 23 35 821 A.

These diaphragms, using a mechanical oscillation, produce the auditorily perceivable signals. In most cases, these elements act as a piston emitter; thus the entire surface of the diaphragm is to be moved equally and evenly. In the state of the art, it is considered that this can generally be achieved only at low frequencies, whose wavelength is large in relation to the diaphragm diameter.

The predominant design of loudspeaker is the electro-dynamic loudspeaker with a central drive. In this type, the diaphragm is driven by the interaction between the electric current and a constant magnetic field. A current-carrying coil is located in the constant magnetic field of the magnet. The well-known electro-dynamic loudspeaker has a central voice coil, but there are also types with remote drives that have also been described.

Dynamic loudspeakers or dynamic cone loudspeakers are designed so that a thin, funnel-shaped diaphragm is elastically and indirectly suspended at the outer edge of the diaphragm via the mechanical connection with a voice coil. Due to the different diameters, materials and shapes of the suspensions there are various flexibilities, depending on the direction of movement and travel. In some loudspeaker chassis, instead of funnel-shaped diaphragms there are dome-shaped or even flat diaphragms, which however demonstrate the same properties in terms of the tension in the state of the art.

For all of these diaphragms, the goal is to have the maximum material strength in the area of the voice coil and the minimum diaphragm thickness around the edge.

Figure 3:
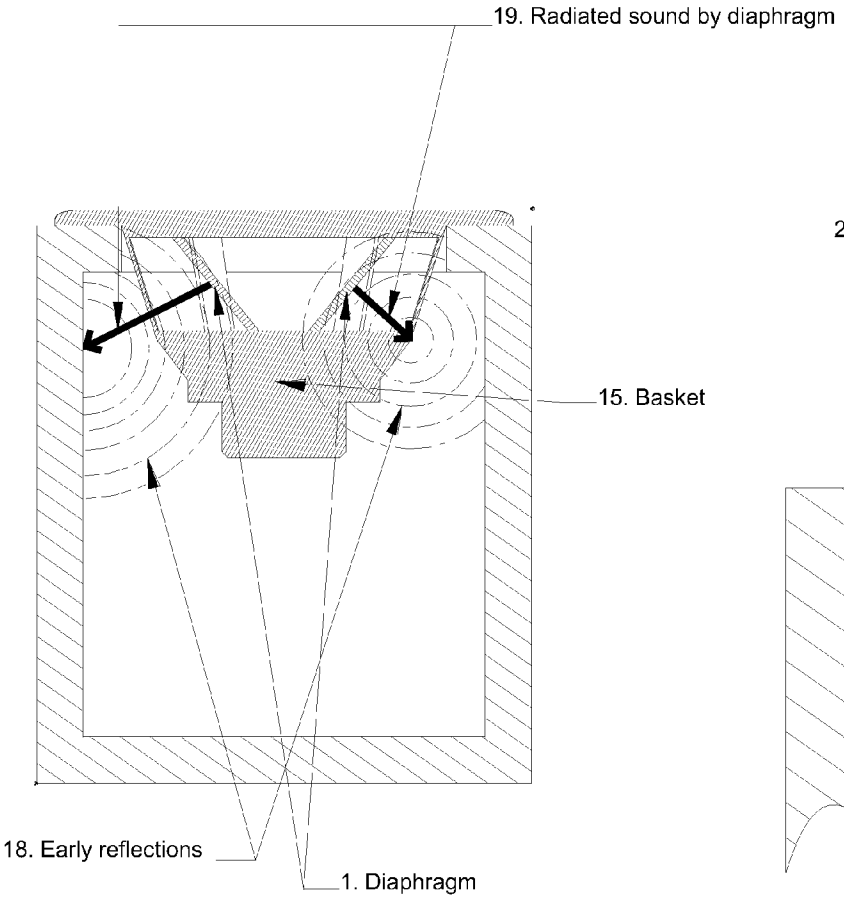
Figure 4:
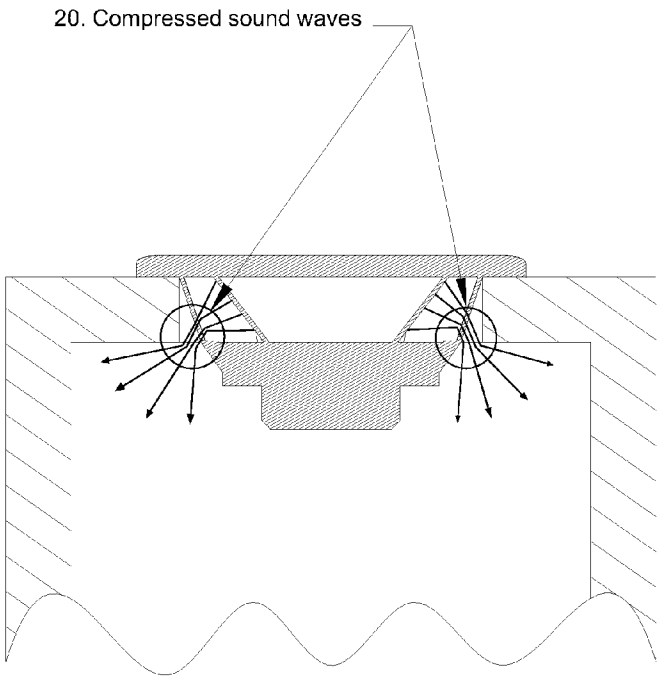

Another characteristic of conventional loudspeaker chassis is the rear sound emission of the loudspeaker diaphragm, whereby the sound is typically routed outside the magnet system (illustrated in FIGS. 3 and 4). This is particularly problematic when a chassis is required with a large voice coil and/or large magnets. In this case, harmful reflections and refractions occur on the magnet system.

In addition, the sound emitted by the dust cover towards the pole core through the narrow pole core holes or the ventilation holes in the diaphragms and voice coil formers does not spread optimally.

This results in nonlinear mechanical losses and in interference in the case of greater diaphragm deflection. For small loudspeakers, the openings in the basket are very short in turn, so that installation in a baffle almost closes them off (see FIG. 4). In the state of the art, the baffle opening is beveled on the inside; because of the resulting sound channel with the disruptive edges, it cannot be avoided that the frequency response of the chassis is significantly deformed by the installation.

Another embodiment of conventional loudspeaker chassis according to the state of the art is the coaxial loudspeaker as described in JP 60 09 1798 A, which additionally has a tweeter that is placed near the low-middle range diaphragm.

In conventional loudspeakers, the voice coils are relatively small in relation to the diaphragm diameter, which results in significant temperature-related dynamic compression. The attempts described in the state of the art to allow larger voice coils by placing magnets within the voice coils have resulted in difficult flow conditions in turn, and are therefore are not an adequate solution to the problem so far.

The object of the invention was therefore to provide a loudspeaker system which does not have the disadvantages of the state of the art and which demonstrates particularly good performance parameters.

It was very surprising that the problem that was the subject of the invention could be solved using a loudspeaker system which included at least one diaphragm, a suspension of it, a magnet system and a voice coil, whereby the suspension of the diaphragm occurs essentially in an axially symmetrical manner around the mechanical resting point in the form of one, preferably two mirrored, identical components. The loudspeaker system includes at least one diaphragm, its suspension, a magnet system and a voice coil, wherein a) the suspension of the diaphragm has an axially symmetrical suspension around the mechanical resting point of this diaphragm and
b) the diaphragm has a thickness of more than 10% of the diaphragm diameter at the outer diameter and
c) the rear main radiation that occurs is at least 50% through the interior of the magnet system.

It was completely surprising that through the combination of the various technical features a functional interaction of these occurs, leading to an improved loudspeaker system that does not have the disadvantages of the state of the art. The term "essentially" within the meaning of the invention is not relative and therefore is an unclear term.

The effects achieved by the invention would not abruptly become unfeasible if the suspension of the diaphragm was not completely symmetrical. The concept of completely symmetrical suspension represents a theoretically possible but practically unfeasible suspension, since even a suspension that is by a very small degree different from the idealized theoretical symmetric suspension may still be considered for solving the problem which is the object of the invention. Therefore, it is pointed out with the term "essentially" that an essentially symmetrical suspension, which functions in the same way and with the same result, is included in the teachings according to the invention of the symmetrical suspension.

The expert in the field of acoustics will recognize what is meant by the term of an axially symmetrical manner around the mechanical resting point in the form of one, preferably two mirrored, identical components for a diaphragm in the sense of the invention, and they will know to what extent they may deviate from the theoretical, fully symmetrical shape in the practically realized, essentially symmetrical suspension in order to complete the purpose of the invention.

Figure 2:
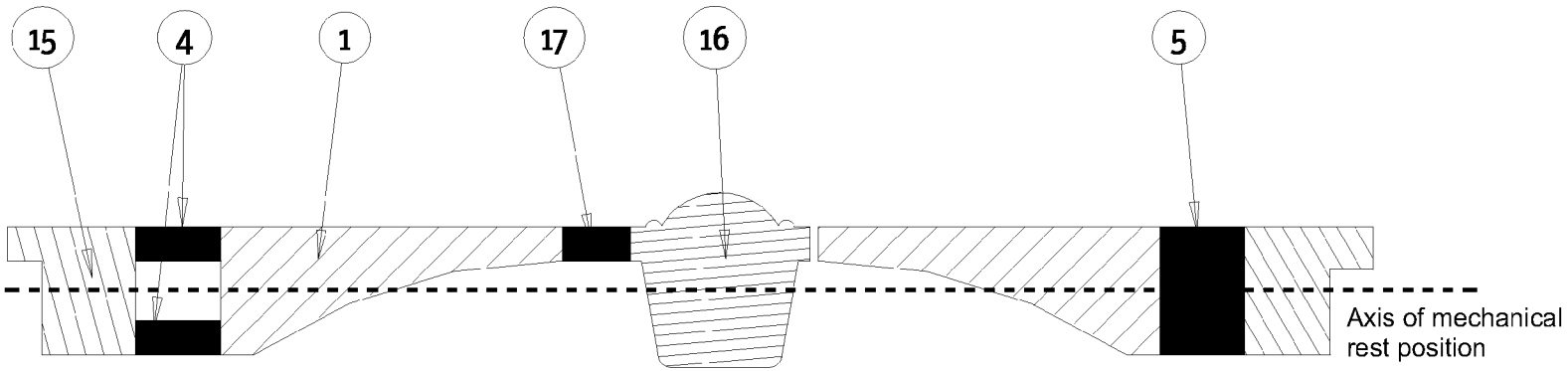

Therefore, what is preferred is the provision of an electrodynamic loudspeaker chassis including either a one-piece symmetrical flexible diaphragm suspension (FIG. 2 (5)) or a mirror-image flexible diaphragm suspension having at least two parts, (see FIGS. 1 (4), 2 (4)). An axially symmetrical suspension around the mechanical resting point in the form of one or two mirrored, identical components is provided (see FIG. 2). The flexible suspension is advantageous if it is completely symmetrical. The term 'fully symmetrical suspension' is known to those skilled in the art of loudspeaker acoustics, who know what is understood to be a fully symmetrical suspension in their field of expertise.

The operation of the loudspeaker system which is the subject of the invention can be surprisingly improved when the diaphragm which is fixed by the described symmetrical suspension has at least the same thickness at the outer diameter of the diaphragm (outer diameter) as in the area of the center of the diaphragm, whereby the diaphragm at the edge, that is to say at the outer diameter of the diaphragm, is more than 10% of the diaphragm diameter.

This means that when the diaphragm diameter has, for example, a value of 10 cm, the diaphragm thickness is more than 1 cm at the outer diameter of the diaphragm. In this case, for example, the diaphragm thickness in the area of the center of the diaphragm would be half a centimeter.

In addition, a loudspeaker system with a technical feature of only a single diaphragm having a thickness at the outer diameter of more than 10% of the diaphragm diameter, surprisingly has beneficial properties during the playback of auditorily perceptible signals.

It was a complete surprise that the oscillation characteristics of the diaphragm could be improved by this type of design which is the subject of the invention.

Advantageously, the increased thickness of the diaphragm (opposite the state of the art), which is a departure from technical norms, allows a symmetrical suspension in the form of one or two mirrored, essentially identical components. The combination of technical features of the suspension according to the invention with those of the diaphragm thickness at the outer diameter of the diaphragm leads to a particularly improved loudspeaker. A very thick diaphragm, at least at the edge, advantageously allows a suspension with particularly low vibration, especially a symmetrical suspension (see FIGS. 1 and 2).

The loudspeaker system according to the invention or the loudspeaker according to the invention is further improved if the rear sound radiation takes place at least 50% through the interior of the magnet system. This is possible, for example, if the voice coil is very large in relation to the diaphragm diameter compared to previous measurements of known devices, so that the rear sound radiation can be carried through the interior of the magnet system (see FIG. 1). One feature of the voice coil is its inductance. To increase the inductance, an electrical conductor, such as a wire coil with a certain number of turns, is applied to the coil body. With the magnetic linkage of the individual turns to each other and with the spatial arrangement of the individual turns, the inductance of the coils increases, preferably by the square of the number of turns.

According to the invention, a voice coil is the drive unit for the loudspeaker. It consists of a thin wire that is wound around a voice coil former. The voice coil enters the gap in the permanent magnet or electromagnet in which there is a magnetic field. The coil support is connected to the diaphragm unit of the loudspeaker. The alternating magnetic field created by the flow of the current moves the voice coil with the diaphragm forwards and backwards and thereby turns the current oscillations into air oscillations.

The rear sound radiation of at least 50% through the center of the magnet design allows sound emission to be achieved with very low air compression.

The very large voice coil in relation to the diaphragm diameter allows a reduction of the dynamic compression by means of voice coil heating.

Due to the very large voice coil, an exterior magnet system is implemented which can consist of individual magnetic segments, for example sub-segments of a ring, round magnetic disks or other desired shapes, or a closed ring, to ensure that the rear sound emission can occur through the center of the magnet design.

If the voice coil diameter is close in size to the diameter of the diaphragm, for example if it is equal, then the area of maximum diaphragm thickness is in the area of the voice coil. According to the invention, a very large circular voice coil should preferably be one that reaches into the edge area of the diaphragm because the voice coil diameter is at least 75% of the diaphragm diameter.

The diameter of the diaphragm and voice coil is of the same size in a preferred embodiment; it may however be the case in further preferred variants of the invention that the diameter of the voice coil is larger than that of the diaphragm.

In a further preferred embodiment of the invention, it is expected that the diaphragm, preferably a woofer diaphragm, in addition to a tweeter, preferably features a dome tweeter (coaxial loudspeaker). A dome tweeter is a dynamic loudspeaker, preferably for frequencies above a range of 2 to 3 kHz, whose diaphragm is formed in particular as a ball cap (calotte). The tweeter preferably has a larger radiation angle at high frequencies than conventional loudspeakers. The tweeter is preferably a stand-alone system which is placed in the woofer diaphragm but without significant or direct interaction with it. The tweeter can be placed in the middle or center, or in any other place in the woofer diaphragm or near the center. In a preferred embodiment, the tweeter is placed in the center of the woofer on an axis.

It is particularly preferred that the magnet system located within the tweeter emits the sound through an opening in the diaphragm of the woofer.

The preferred dimensions of the magnet system specifically include a center-mounted tweeter in the bass diaphragm within the magnet system. The tweeter can be, for example, a product as described in DE 20 2004 015 635 111.

If, in the aforementioned preferred embodiment, the loudspeaker system according to the invention has a tweeter in addition, it can be expected, for example, that the combined loudspeaker system includes an external and an internal suspension (FIGS. 2 (4, 5 and 17)). The concepts of inner and external suspension are self-explanatory for the specialist. If a tweeter is placed in a woofer diaphragm, there is an outer edge of the woofer diaphragm on the one hand and on the other there is an outer edge of the tweeter diaphragm, the latter being at least partially surrounded by the woofer diaphragm. The outer suspension would serve, for example, for centering or positioning the diaphragm for the low/middle range.

The so-called inner ring is the area of the outer edge of the tweeter that is surrounded by the diaphragm for the low/middle range. The range and/or gap between the woofer and low/mid-range diaphragm and the tweeter can be preferably sealed by materials known to the specialist, so that the diaphragm motion of the loudspeaker for the low/middle range is not restricted and that cone resonances are damped (FIG. 2 (17)).

In another preferred embodiment of the invention, there is accordingly at least one area at the outer edge of the diaphragm onto which the outer suspension (bead) is attached and which is formed by resilient open-cell or closed-cell foam that is preferably permanently elastic. Of course, it can also be expected that instead of the conventional suspension of the diaphragm, the diaphragm is centered by positioning the diaphragm within the chassis using foam. For example, it may be preferable that the diaphragm is positioned or centered for the low/middle range using a fabric such as acrylic, Nomex and/or cotton fabric in combination with Phenol and/or epoxy resin, or that it is positioned or centered using a rubber construction in the form of a suspension.

It was very surprising that these aforementioned technical features in combination with those further design features according to the invention lead to the construction of a coaxial loudspeaker that has improved sound quality over known devices.

The use of foam as an internal suspension and as a seal for the air gap between the low/middle range diaphragm and the tweeter is particularly preferred with the aforementioned combination of diaphragm and tweeter, especially when the basic design for low/middle range is a flat surface which then forms the immediate environment of the tweeter. It was very surprising that the use of foam as the inner suspension allows the design of a coaxial loudspeaker that has improved sound quality over the known devices.

In another preferred embodiment of the invention, the magnet system includes at least one magnet from the group comprising a samarium-cobalt magnet, a cerium-cobalt magnet, an aluminum-nickel-cobalt magnet, a ferrite magnet and/or preferably a neodymium magnet.

The loudspeaker system according to the invention preferably has a diaphragm that is specifically designed as a sandwich diaphragm, which can have a rigid form from the combination of core material and outer surface layer.

Preferably, the core material is a honeycomb structure and can, for example, be formed from aramid fibers, paper, polyester, polypropylene or aluminum. The outer surface layer of the diaphragm may include fiber materials, metal foils and/or plastic films. The fiber materials can be, for example, paper or cotton. Of course, it is also possible to use technical fabrics of carbon fibers or glass/aramid fibers or scrim, in which unidirectional fibers lie next to each other.

When fabrics of carbon, glass or aramid fibers are used, the fabric must possess a matrix-like structure at least on one side, which may for example be made of thermoplastic or thermosetting plastics.

The fiber-based materials may preferably be fiber-plastic composites, which consist of reinforcing fibers and a plastic matrix. The matrix surrounds the fibers that are bound to the matrix using adhesives or cohesive forces. According to the invention, the fiber-plastic composite can be perceived as a construction.

Its elements must be combined so as to create the desired properties. Through the interaction of the specific properties of the fiber material and matrix material, the desired starting materials for the diaphragm coating or diaphragm reinforcement may be created. Fibers are embedded in the matrix, i.e. the fibers are fixed in space, allowing for load entry and exit. In addition, the matrix supports the fibers. The load is transmitted by the adhesion between fiber, matrix and core. The fibers may be, for example, aramid, carbon, polyester, nylon, polyethylene, ceramic, glass, boron, flax, hemp fibers and/or other fibers.

In the following, the invention is further described with examples, without being limited to these examples.

The figures show:

FIG. 1: Cross-section through a diaphragm according to the invention and a loudspeaker chassis, wherein the diaphragm is centered and positioned by means of a flexible diaphragm suspension that is assembled from two mirror-image components.

FIG. 2: Cross-section of a diaphragm according to the invention, with a centrally mounted tweeter.

FIGS. 3 & 4: Show the cross-section of a housing wall in a loudspeaker system.

FIG. 1 shows an electro-dynamic loudspeaker chassis, which features the axially symmetric suspension around the mechanical resting position of the diaphragm in the form of two mirrored, identical components (4) and the voice coil which is similar in size to the diaphragm diameter along with a voice coil former (6, 7) while the rear sound radiation primarily takes place through the interior of the magnet system (10, 11, 12). To implement this sample construction type, a very thick diaphragm (1) is necessary in the edge region. The very thick diaphragm, at least the edges of the sample, allows for a low-vibration, symmetrical suspension (4).

A sample, completely symmetric suspension around the mechanical resting position of the diaphragm in the form of two mirrored, identical components allows the construction of an advantageous loudspeaker system. A voice coil which is similar in size to the diaphragm diameter, along with a voice coil former (6, 7) for the reduction of the dynamic compression caused by voice coil heating improves the sample loudspeaker system as well. The external magnet system (10, 11, 12) consists of individual magnet segments or a closed ring in order to ensure that the main sound emitted from the center of the magnetic structure takes place with very low air compression.

Another advantage of the design results when it is set up as a coaxial loudspeaker (as in FIG. 2). The tweeter is in a flat surface in the form of a cone diaphragm. In addition, this flat surface can be optimized when instead of a suspension of corrugated fabric or foam rubber fold, a straight foam ring for suspending the diaphragm is used (17). The tweeter (16) of any type radiates its sound from a hole in the woofer diaphragm. The tweeter in this example is within the magnet system of the loudspeaker. In the case of the sample combination with the tweeter the result—in addition to the benefits of the basic design—for the low/middle range is the great advantage of a flat surface in the immediate vicinity of the tweeter, especially when using foam as the inner suspension. The use of a foam with a flat surface shape as the loudspeaker suspension (FIG. 2 (4, 5, 17)) for coaxial speakers with a flat or slightly curved diaphragm surface is particularly advantageous.

A prerequisite for the meaningful acoustic functioning into the middle range is the use of modern lightweight materials for the diaphragm.

FIGS. 3 and 4 show a characteristic feature of conventional loudspeaker chassis with the rear sound radiation of the loudspeaker diaphragm, whereby the sound is typically passed to large parts of the magnet system. This is particularly problematic when a chassis with a large voice coil and/or large magnet is required. In this case, harmful reflections and refractions occur on the magnet system. FIG. 4 shows the problem with very small loudspeakers.

The close proximity to the housing walls in the known chassis leads to strong reflections from inside the walls, which are emitted through the diaphragm to the outside and thus create acoustic interference (18). A dampening at this location is not effectively possible due to a lack of space. For this reason, in current loudspeakers it is recommended to use wide baffles to avoid the aforementioned problems. In the sample construction in FIG. 1, the primarily emission is firstly implemented via the center of the chassis and therefore takes place without any interference from the nearby walls.

Secondly, the sound escaping from the sides is better dampened when reflected to the outside, because it has to pass through two diaphragm parts with air volumes inbetween.

REFERENCE LIST

FIG. 1:
1 diaphragm
2 core material
3 surface layer
4 axially symmetric suspension around the mechanical resting position of the diaphragm in the form of two mirrored, identical components
6 voice coil former
7 Voice coil
8 lead wire
9 terminal
10 upper pole plate
11 bottom pole plate
12 magnet
13 distance cube
14 screw
15 basket FIG. 2:
1 diaphragm
4 axially symmetric suspension around the mechanical resting position of the diaphragm in the form of two mirrored, identical components
5 axially symmetric suspension around the mechanical resting position of the diaphragm in the form of one component
15 basket
17 inner suspension/sealing ring
16 tweeter FIG. 3:
1 diaphragm
15 basket
18 early reflections
19 radiated sound by diaphragm FIG. 4:
20 compressed sound waves

The invention claimed is:

1. Loudspeaker system, comprising at least one diaphragm, a magnet system and a voice coil, wherein the diaphragm is flat along an axis of a mechanical rest position of the diaphragm and possesses a mounting suspension comprising two identical mirrored components along said axis and the magnet system is an external magnet system in form of a ring having an interior, wherein the magnet system is configured so that a rear main emission occurs at least 50% through the interior of the magnet system, the diaphragm, having a outer diameter and a center, is thicker at the outer diameter than in the center and has, at the outer diameter, a thickness of more than 10% of the diaphragm diameter, and the diameter of the voice coil in relation to the diameter of the diaphragm is at least 0.75:1.

2. The loudspeaker system according to claim 1, wherein the diaphragm is formed as a woofer diaphragm and also comprises a tweeter.

3. The loudspeaker system according to claim 2, wherein the tweeter located within the magnet system emits the sound through an opening in the diaphragm of the woofer.

4. The loudspeaker system according to claim 1, wherein at least one area of a loudspeaker bead of the diaphragm is formed by resilient foam.

5. The loudspeaker system according to claim 1, wherein the magnet system comprises at least one magnet, selected from the group comprising a samarium-cobalt magnet, a cerium-cobalt magnet, an aluminum-nickel-cobalt magnet, a ferrite magnet and a neodymium magnet.

6. The loudspeaker system according to claim 1, wherein the diaphragm is a sandwich diaphragm.

7. Loudspeaker system, comprising at least one diaphragm, a magnet system and a voice coil, wherein the diaphragm possesses a mounting suspension and the magnet system is an external magnet system in form of a ring having an interior, wherein the magnet system is configured so that a rear main emission occurs at least 50% through the interior of the magnet system, the diaphragm, having a outer diameter and a center, is thicker at the outer diameter than in the center and has, at the outer diameter, a thickness of more than 10% of the diaphragm diameter, and the diameter of the voice coil in relation to the diameter of the diaphragm is at least 0.75:1, wherein the diaphragm is a sandwich diaphragm and the core material of the sandwich diaphragm comprises a honeycomb structure made of aramid fibers, paper, Nomex, plastic and/or wherein the outer surface layers comprises fiber materials, metal foils and/or plastic films.

8. The loudspeaker system according to claim 1, wherein the diaphragm is formed as a woofer diaphragm and also comprises a tweeter and the tweeter inside the magnet system emits the sound through an opening in the diaphragm of the woofer.

9. The loudspeaker system according to claim 2, wherein the tweeter is a dome tweeter.

10. The loudspeaker system according to claim 3, wherein the tweeter is a dome tweeter.

11. The loudspeaker system according to claim 8, wherein the tweeter is a dome tweeter.

12. The loudspeaker system according to claim 7, wherein the plastic is -polyester and/or polypropylene.

13. The loudspeaker system of claim 7, wherein the suspension is a one- piece symmetrical flexible suspension.

14. The loudspeaker system of claim 1, wherein the suspension is a fully symmetrical suspension.

* * * * *